United States Patent [19]

Ohta et al.

[11] 4,015,984

[45] Apr. 5, 1977

[54] INORGANIC PHOTOCONDUCTOR IN GLASS BINDS WITH GLASS OVERCOAT LAYER

[75] Inventors: Wasaburo Ohta; Koji Hirakura, both of Tokyo, Japan

[73] Assignee: Kabushiki Kaisha Ricoh, Tokyo, Japan

[22] Filed: May 28, 1975

[21] Appl. No.: 581,492

Related U.S. Application Data

[63] Continuation-in-part of Ser. No. 469,857, May 14, 1974, abandoned.

[30] Foreign Application Priority Data

May 17, 1973 Japan ..... 48-054872
July 18, 1973 Japan ..... 48-080268

[52] U.S. Cl. ..... 96/1.5; 96/1.8; 96/1 R; 252/501

[51] Int. Cl.[2] ..... G03G 5/04

[58] Field of Search ..... 96/1.5, 1.8; 252/501

[56] References Cited

UNITED STATES PATENTS

| | | | |
|---|---|---|---|
| 2,886,434 | 5/1959 | Owens | 252/501 X |
| 2,930,999 | 3/1960 | Van Santen et al. | 252/501 X |
| 2,937,353 | 5/1960 | Wasserman | 252/501 X |
| 3,151,982 | 10/1964 | Corrsin | 96/1.8 |
| 3,288,604 | 11/1966 | Corrsin | 96/1.5 |
| 3,745,504 | 7/1973 | Mooney | 252/501 X |
| 3,754,965 | 8/1973 | Mooney | 252/501 X |
| 3,816,117 | 6/1974 | Kaukeinen | 96/1.5 |
| 3,837,906 | 9/1974 | Jones | 96/1.5 |
| 3,874,942 | 4/1975 | Negishi et al. | 96/1.5 |

FOREIGN PATENTS OR APPLICATIONS

| | | | |
|---|---|---|---|
| 2,139,609 | 2/1973 | Germany | 96/1.5 |

*Primary Examiner*—Roland E. Martin, Jr.
*Attorney, Agent, or Firm*—Cooper, Dunham, Clark, Griffin & Moran

[57] ABSTRACT

The present invention relates to a photosensitive material for use in electrophotographic processes requiring at least two stages of charging which is superior in sensitivity, durability and hydrophilicity, said photosensitive material comprising a conductive substrate on which there is (1) a photoconductive layer containing an inorganic photoconductive substance and an inorganic glass and (2) a transparent insulating layer which is an inorganic glass, and may include a protective thin layer of a metal oxide.

5 Claims, No Drawings

INORGANIC PHOTOCONDUCTOR IN GLASS BINDS WITH GLASS OVERCOAT LAYER

RELATED APPLICATION

This application is a continuation-in-part of our copending application Ser. No. 469,857 filed May 14, 1974, now abandoned.

BACKGROUND OF THE INVENTION a. Field of the Invention

The present invention relates to photosensitive materials for use in electrophotographic processes requiring at least two stages of charging having markedly improved properties of sensitivity, durability and hydrophilicity due to the presence of a transparent insulating layer on a photoconductive layer, coupled with the employment of an inorganic glass in each of these layers.

b. Description of the Prior Art

Image-transferring processes, in which an electrostatic latent image is formed onto a photosensitive material consisting of a conductive substrate, a photoconductive layer and a transparent insulating layer by means of electrophotographic processes comprising at least two stages of charging; said latent image is developed with a dry or wet developer; and the resulting image is transferred to a receiving sheet, have been proposed in, for example, Japanese Publication Nos. 19748/1967, 24748/1968 and 2965/1973 and U.S. Pat. Nos. 3438706, 3615395, 3692519 and 3677751. One of these electrophotographic processes (referred to as "A process") comprises (a) carrying out the first charging of a photosensitive material prepared by forming a photoconductive layer and transparent insulating layer, in order, on a substrate and either (b) performing the second charging simultaneously with an image-wise exposure or (b)′ performing an image-wise exposure immediately after the second charging by AC corona charge or by electricity with a polarity opposite to that in the first charging and, as occasion demands, (c) subjecting the thus charged material to an overall exposure, to thereby form an electrostatic latent image. Another process (referred to as "B process") comprises either (a) performing the first charging of the same photosensitive material as above in the light or (a)′ subjecting the same to an overall exposure after the first charging, (b) performing the second charging of said material in the dark with an electric charge having a polarity opposite to that in the first charging, and (c) subsequently performing an image-wise exposure to thereby form an electrostatic latent image. There have also been proposed various modifications of the foregoing electrophotographic processes requiring at least two stages of charging. These electrophotographic processes proposed heretofore have merit in that materials with low resistivity and high sensitivity like cadmium sulfide and cadmium selenide can be utilized as photoconductors for the processes, and that extremely high sensitivity can thus be obtained in comparison with the so-called Carlson's electrophotographic process which comprises forming, by means of charging and image-wise exposure, an electrostatic latent image onto a photosensitive material comprising a photoconductive layer formed on a conductive substrate. However, these processes have not achieved wide utilization since the substances which serve as binders for the photoconductive layer and for the transparent insulating layers are organic high-molecular resins. They have some defects: when the insulating layer of high molecular resins is repeatedly subjected to charging stages, the electrical and physical properties, such as transparency, surface smoothness and resistance to abrasion, of said layer are liable to be deteriorated.

SUMMARY OF THE INVENTION

One object of the present invention is to overcome the foregoing defects and to provide a photosensitive material having superior durability through the improvements in weather, abrasion, heat and solvent resistivity.

Another object of the present invention is to provide a photosensitive material with high sensitivity.

A further object of the present invention is to provide a photosensitive material which may be used directly as a printing plate after forming a fixed image thereon and without applying any further treatment, such as etching.

More specifically, the present invention relates to photosensitive materials for use in electrophotographic processes comprising at least two stages of charging as described above, said materials being prepared by forming a photoconductive layer containing an inorganic photoconductive substance and an inorganic glass binder and a transparent insulating layer containing an inorganic glass, in order, on a conductive substrate. It also relates to a photosensitive material for use in electrophotography which is prepared by further forming a protective thin layer of a metal oxide on the said transparent insulating layer. For the purpose of improving the resolving power of the present photosensitive material, a high-dielectric substance may be added to the transparent insulating layer.

Typical of the inorganic glasses which may be used in the present invention are those of the following composition:

| | |
|---|---|
| $B_2O_3$, $SiO_2$ | 26–67 wt. % |
| $(R_1)_2O$ | 6–30 wt. % |
| $(R_2)O$ | 15–51 wt. % |
| $(R_3)_2O_3$ | 0–10 wt. % |
| $(R_4)O_2$ | 0–15 wt. % |

wherein $R_1$ is an alkali metal such as Na, K and Li;

$R_2$ is Ba, Zn, Ca, Mg, Pb, Cd or Sr;

$R_3$ is Al, Sb or As; and $R_4$ is Ti, Zr or Sn.

Inorganic glasses applicable to the present invention are not limited to the foregoing borosilicate glass. However, the inorganic glass utilized should not react with the photoconductive substance selected for use in the photosensitive material.

The inorganic photoconductive substances which may be used in the present invention include all of those substances which have been employed in conventional photosensitive materials utilizing resinous binders; such as chalcogenides of zinc and cadmium represented by cadmium sulfide, zinc oxide, cadmium selenide, cadmium telluride, etc., and solid solutions or mixtures of optional combinations of these chalcogenides. It further includes calcium sulfide-strontium mixtures, zinc arsenide, arsenic sulfide, lead monoxide, gallium selenide, indium sulfide, arsenic selenide, mercuric oxide, titanium dioxide, zinc titanate, zinc oxide-magnesium mixtures, red leads, etc. The above enumerated photoconductive substances ar of course applicable even when activated with proper impurities.

The inorganic high-dielectric substances utilized in the present invention will have a specificc dielectric constant of from $10^2$ to $10^4$, and it includes, for instance, substances such as barium titanate, bismuth titanate, strontium titanate, lead titanate, lead zirconate and lead stannate as well as solid solutions and mixtures thereof, lead iron tantalate, potassium dihydrogen phosphate, Rochelle salts and antimony sulfur iodide.

Any of a variety of conductive substrates may be used in this invention. These include, for example, a glass plate laminated with a plate or foil of a metal such as stainless steel or aluminum. It also includes heat-resisting resin plates and the like.

To prepare a photosensitive material according to the present invention, the selected inorganic glass powder and inorganic photoconductive substance powder are kneaded in a small amount of water to form a dispersion. The resulting kneaded mixture is coated on a substrate, dried and calcined in, for example, an electric furnace to thereby form a photoconductive layer. This layer is coated with a glass powder slurry in a small amount of water which may contain an inorganic high-dielectric substance. The thus coated glass powder is calcined as described above to form an insulating layer. The mixing ratio of photoconductive substance to glass in the photoconductive layer is normally from about 1:4 to 2:1 by weight. The amount of the high-dielectric substance suitable for improving the resolving power is required to be up to 25%, by weight, of that of the glass powder, but the use of the high-dielectric substance in an amount exceeding said range reduces the light-transmissivity of the insulating layer, thus lowering the sensitivity.

The thickness of the photoconductive layer is desirably in the range of from 10 to 100 $\mu$. The thickness of the insulating layer varies with the electrophotographic process and the like employed. The optimum thickness of the insulating layer is from 5 to 50 $\mu$.

To more improve the moisture resistance of the photosensitive materials of this invention, a coating film of a metal oxide such as silicon dioxide, titanium oxide, aluminum oxide, etc. may be formed on the surface of the insulating layer. The coating of a metal oxide is effected by vacuum evaporation or sputtering. The thickness of the coating is preferably in the range of 20 A to 1 $\mu$.

The photosensitive material according to the present invention, which is applied to electrophotographic processes comprising at least two stages of charging, that is, said A or B process, has high sensitivity compared with the conventional photosensitive materials which utilize organic high-molecular resins as photoconductive and insulating layers. Additionally, the addition of an inorganic high-dielectric substance to the insulating layer improves the resolving power. The products of the invention have excellent abrasion resistance (Vickers hardness of the photosensitive material according to the present invention is in the range of from 500 to 600 while said hardness of the conventional photosensitive material employing a resin is in the range of from 8 to 15) as well as weather, corona-discharge, heat and liquid-developer resistivity. Therefore, the photosensitive material according to the present invention may be used for much longer periods than conventional materials. Moreover, since the top surface is hydrophilic, the photosensitive materials may be used as a printing plate for offset printing directly upon forming a fixed copied image thereon, and without applying any further treatment.

The following non-limiting examples are given by way of example only.

EXAMPLE 1

A mixture was prepared by mixing 15 wt.% of $B_2O_3$, 18 wt.% of $SiO_2$, 25 wt.% of BaO, 8 wt.% of $Na_2O$, 14 wt.% of $K_2O$, 14 wt.% of ZnO, 4 wt.% of $TiO_2$ and 2 wt.% of $Li_2O$, PbO and $Al_2O_3$ collectively (all of these compounds were reagents of special grade). This mixture was put in an alumina crucible free of impurities and was melted by heating at a temperature of 1100° C. for about 3 hours. The resulting melt was poured into water, whereby a granular solid frit was obtained. 100 g of this frit were subjected to wet pulverization by means of a porcelain ball-mill for 21 hours upon adding 40 cc of distilled water thereto, whereby a glaze perfectly passable on a 325-mesh sieve (i.e., a glaze which leaves no residue behind when passed on a 325-mesh sieve) was obtained. Next, 65 g of cadmium sulfide powder (cadmium sulfide No. 118-8-2, the manufacture of General Electric Co., USA) were added to this glaze and dispersed therein by the use of a homogenizer for 10 minutes. The thus prepared dispersion was coated on a 0.3 mm thick stainless steel grease free plate (18 Cr, 8 Ni) by the use of a spray gun before cadmium sulfide and glass powder began to precipitate. Upon drying the coating until just before the occurrence of cracks therein, said stainless steel plate was put in an electric furnace held at a temperature of 596° C and was subjected to 6 minutes calcination, whereby a 60 $\mu$-thick photoconductive layer was formed. Subsequently, a 15 $\mu$-thick insulating layer was formed on this photoconductive layer by coating, drying and calcining it with the same frit as described above. The coating was thoroughly washed with water, and dried to produce a photosensitive material of the invention.

Next, this photosensitive material was charged with positive electricity by corona discharge in the light and then was charged with negative electricity in the dark. When an optical image was applied to the photosensitive material immediately thereafter to form an electrostatic latent image thereon and then a commercial dry developer with a toner concentration of 1.5 wt.% (namely, a dry developer consisting of KP-4 dry toner manufactured by DAINIPPON INK K.K. and FAX-P-P glass-beads carrier) was sprinkled over said latent image, there was obtained a visible image with high resolving power and high density under a dry condition at room temperature. Further, this toner could be transferred to an ordinary paper by means of negative corona discharge on the side of said paper and fixed by heating.

When an electrostatic latent image formed through the foregoing process was developed with a commercial wet developer (namely, the toner for use in BS-470 manufactured by K.K. RICOH wherein the toner content is 3 wt.% and Isopar H manufactured by ESSO Standard Co. is employed as the carrier), a stable visible image with high resolving power and high density could be obtained even under humidity as hgh as 80%

RH. This toner image could be similarly transferred to an ordinary paper as described above.

When the insulating layer surface of the photosensitive material in the present example was first charged with positive electricity in the dark, next charged by AC corona discharge or charged with negative electricity simultaneously with the application of an optical image, and further subjected to an overall exposure to light, followed by the development through the dry-developing process, there was obtained an image with high resolving power and high contrast.

The amount of exposure required for the purpose of obtaining an electrostatic latent image necessary for forming a satisfactory visible image in the present example was in the range of from 7 to 10 lux.sec when a standard tungsten lamp with a color temperature of 2854° C was employed as the light source.

EXAMPLE 2

100 g of the frit AL 80 manufactured by NIPPON FELLOW K.K. for use in the non-lead aluminum enamel and 12 g of a floating agent AL 30 J manufactured by the same company were put in a porcelain ball-mill together with 40 cc of distilled water and subjected to wet pulverization, whereby a glass powder perfectly passable on a 325-mesh sieve was obtained. Next, 67 g of cadmium No. 118-8-2 manufactured by General Electric Co., USA were added to this glass powder and dispersed therein by the use of a homogenizer for 15 minutes, whereby a homogenous dispersion (glaze) consisting of said glass powder and cadmium sulfide powder was prepared. The thus prepared dispersion was coated on a 0.5 mm-thick grease-free aluminum plate (Japanese Industrial Standard grade No. 3) by the same means as in Example 1, dried and subjected to 7 minutes calcination within an electric furnace, whereby a 60 $\mu$-thick photoconductive layer was formed. Subsequently, by coating a glaze not containing any cadmium sulfide on this photoconductive layer, drying and calcining to form an insulating layer, a photosensitive material was prepared. This photosensitive material displayed a stronger adhesion between the photoconductive layer and the substrate compared with the photosensitive material in Example 1. Next, when the insulating layer of this photosensitive material was first charged with positive electricity in the light, next charged with negative electricity in the dark, subjected to application of an optical image thereafter, and then developed with the same dry or wet toner as applied to Example 1, there was obtained an image with high resolving power and high density. Further, when this photosensitive material was first charged with positive electricity in the dark and thereafter charged with electricity by AC corona discharged or charged with negative electricity simultaneously with the application of an optical image, and further subjected to an overall exposure to light, the same result as above was obtained.

EXAMPLE 3

A photosensitive material was prepared in the same way as in Example 2 except for substituting a standard cadmium sulfide (having a brown color and containing some activator) manufactured by TAISEI KAKO K.K. for the cadmium sulfide No. 118-8-2 employed in Example 2. The sensitivity of this photosensitive material proved superior to that of Example 1 and Example 2, and the amount of exposure required was in the range of from 2 to 3 lux.sec.

EXAMPLE 4

Both in the case where the photosensitive materials obtained in Examples 1 – 3 were further provided with an about 50 A-thick layer of silicon dioxide formed on the insulating layer thereof through vacuum evaporation respectively and in the case where the same materials were respectively provided with an about 4000 A-thick layer of aluminum oxide formed on the insulating layer thereof through the process of forming an aluminum layer by vacuum evaporation of aluminum and effecting anodic oxidation of the resulting aluminum layer, a stable image could be obtained in the same way as in the foregoing examples even under a high humidity such as 95% RH.

EXAMPLE 5

A slurry consisting of 100 g of the same frit as used in Example 1, 15 cc of distilled water and 5 g of barium titanate powder with specific dielectric constant of 1500 (at the room temperature) was subjected to wet-pulverization within a porcelain ball-mill, whereby a glaze powder perfectly passable on a 325-mesh sieve was obtained. Next, through the procedure comprising forming a 15 $\mu$-thick insulating layer on the same photoconductive layer as that in Example 1 by coating it with the foregoing glaze powder by the same means as in Example 1, drying and calcining, and subsequently thoroughly washing away the residual component of said glaze remaining after the calcination with water and drying again, a photosensitive material according to the present invention was prepared.

When an image was formed on this photosensitive material in the same way as in Example 1 and the transfer of said image was conducted, the result was substantially the same as that in Example 1.

While the specific dielectric constant of the photosensitive material in Example 1 was 8.5, the value of the photosensitive material in the present example was 90. Accordingly, the resolving power of the photosensitive material in the present example was far higher than a commercial photosensitive material.

EXAMPLE 6

A dispersion was prepared by adding 5 g of a high-dielectric powder with specific dielectric constant of 8000 (at room temperature) consisting of a solid solution of $BaTiO_3$, $SrTiO_3$ and $BaSnO_3$ as mised at the weight ratio of 8:3:1; a manufacture of KOKUSAN KAGAKU K.K. to 100 g of the same glass powder as used in Example 1 and dispersing in the same way as in Example 1. Subsequently, by coating this dispersion on the same photoconductive layer as that in Example 2, drying and calcining to form a 15 $\mu$-thick insulating layer, a photosensitive material according to the present invention was prepared. This photosensitive material proved to be superior in coherence of the photoconductive layer and the substrate. When an image was formed on this photosensitive material in the same way as in Example 1, the result was the same as that in Example 1.

EXAMPLE 7

A photosensitive material was prepared in the same way as in Example 6 except for substituting a standard cadmium sulfide (having a brown color and containing some activator) manufactured by TAISEI KAKO K.K. for the cadmium sulfide No. 118-8-2 employed in Example 2. The sensitivity of this photosensitive material was similar to the product produced in Example 3, and the amount of exposure required was in the range of from 2 to 3 lux.sec.

EXAMPLE 8

The photosensitive materials obtained in Examples 5–7 were further provided with an about 50 A-thick layer of silicon dioxide formed on the insulating layer by vacuum evaporation respectively. Other samples of the same materials were provided with an about 4000 A-thick layer of aluminum oxide formed on the insulating layer thereof through the process of forming an aluminum layer by vacuum evaporation of aluminum and effecting anodic oxidation of the resulting aluminum layer. In all cases stable images could be obtained in the same way as in the foregoing examples even under a humidity as high as 95% RH.

The products of the foregoing examples, after dry development, were subjected to heating or treatment with toluene vapor to fix the toner image. Subsequently, upon wetting their surface with water, the thus processed photosensitive materials served as the offset printing plates for use in printing with a commercial offset printing machine (by applying the B-type offset ink manufactured by K.K. RICOH). The photosensitive materials of the invention provided prints with high resolving power and high density. The sensitivity of these master printing plates is more than 10 times as high as that of the normal zinc oxide-sensitizer-resin containing master plates. Moreover, no etching is required and, in contrast to normal plates, they are reclaimable.

What is claimed is:

1. A photosensitive material for use in electrophotography requiring at least two stages of charging, comprising a conductive substrate coated with a photoconductive layer containing an inorganic photoconductive substance and an inorganic glass and a transparent, inorganic glass insulating layer containing an inorganic high-dielectric substance, the said substance having a specific dielectric constant of from $10^2$ to $10^4$, the weight ratio of the inorganic photoconductive substance to the inorganic glass in the photoconductive layer being in the range of from 1:4 to 2:1, and the amount of the inorganic high-dielectric substance in the insulating layer being up to 25% by weight of that of the inorganic glass.

2. A photosensitive material according to claim 1, wherein the thickness of the insulating layer is in the range of from 5 to 50 $\mu$.

3. A photosensitive material according to claim 1, wherein the insulating layer is further provided with a thin, protective layer of a metal oxide having a thickness of from 20 A to 1 $\mu$.

4. A photosensitive material according to claim 3, wherein said metal oxide is selected from the group consisting of silicon oxide, titanium oxide and aluminum oxide.

5. A photosensitive material according to claim 1, wherein said inorganic high-dielectric substance is selected from the group consisting of barium titanate, bismuth titanate, strontium titanate, lead titanate, lead zirconate, lead stannate and solid solutions and mixtures thereof, lead iron tantalate, potassium dihydrogen phosphate, Rochelle salt, and antimony sulfur iodide.

* * * * *